United States Patent [19]

Hansen

[11] Patent Number: 5,046,627

[45] Date of Patent: Sep. 10, 1991

[54] AMPULE

[76] Inventor: Bernd Hansen, Heerstrasse 16, 7166 Sulzback-Laufen 2, Fed. Rep. of Germany

[21] Appl. No.: 521,378

[22] Filed: May 10, 1990

[30] Foreign Application Priority Data

May 24, 1989 [DE] Fed. Rep. of Germany ..... 3916840

[51] Int. Cl.[5] ..... A61J 1/06; B65D 85/42

[52] U.S. Cl. ..... 215/31; 215/32; 141/310; 206/528; 206/532

[58] Field of Search ..... 215/31, 32; 206/528; 141/310; 604/405, 416

[56] References Cited

U.S. PATENT DOCUMENTS

| | | | |
|---|---|---|---|
| 3,143,251 | 8/1964 | Barton et al. | 222/209 |
| 3,356,244 | 12/1967 | Witchell | 215/32 |
| 4,643,309 | 2/1987 | Evers | 215/32 X |
| 4,926,915 | 5/1990 | Deussen et al. | 215/32 X |

FOREIGN PATENT DOCUMENTS

| | | | |
|---|---|---|---|
| 0088056 | 9/1983 | European Pat. Off. . | |
| 327397 | 8/1989 | European Pat. Off. | 206/528 |
| 350772 | 1/1990 | European Pat. Off. | 215/32 |

*Primary Examiner*—Sue A. Weaver

*Attorney, Agent, or Firm*—Roylance, Abrams, Berdo & Goodman

[57] ABSTRACT

An amplule for a liquid, removed from the ampule by a hypodermic syringe, has a neck. A conical member on one end of the hypodermic syrings is introduced into the neck of the ampule. The inside wall of the neck of the ampule is of a configuration which allows for the passage of air, but does not allow the passage of liquid in the area intended for the installation of the conical member. The shaped configuration between the socket member wall and the inside wall of the neck of the ampule is in the form of a circular closed line.

7 Claims, 2 Drawing Sheets

AMPULE

FIELD OF THE INVENTION

The present invention relates to an ampule for a liquid, preferably a plastic ampule. The liquid may be removed from the ampule by means of an injection or hypodermic syringe, i.e., without a needle. The hypodermic syringe incorporates a conical member on its end which is introduced into the neck of the ampule.

BACKGROUND OF THE INVENTION

In an known ampule of this type (European Patent 0 008 856 A1), the neck forms a cone with inside dimensions adapted to the dimensions of the standard conical member which is part of the hypodermic syringe. This construction avoids the requirement of attaching an injection needle in some manner to the conical member of the separate hypodermic syringe before the first injection needle is introduced into the ampule and before a second injection needle can be used for the injection. However, since the conical member produces a sealed connection with the inside cone of the neck, the ampule must be able to collapse in order to be able to completely remove the liquid contained in the ampule.

It is indeed desirable that the connection between the ampule and the hypodermic syringe be sealed during removal of the liquid from the ampule, so that during the removal process the ampule can also be turned upside down, without the liquid being lost. On the other hand, however, up until the removal of the liquid, the absence of stability in the form of or shape of the ampule causes interference.

As used in this application, "hypodermic or injection syringe" is a syringe to be used with a hollow needle for injection of material. The term "hypodermic needle" is a hypodermic syringe complete with a needle.

SUMMARY OF THE INVENTION

An object of the present invention is to provide an ampule in which the contents can be removed by means of a hypodermic syringe without the additional application of a separate hollow tubular needle.

Another object of the present invention is to provide an ampule which will not leak its liquid contents when the neck of the ampule points downward, and can still be configured to be stable in its form and shape.

The foregoing objects are obtained by an ampule, especially made of plastic, for a liquid to be removed from the ampule by a hypodermic syringe with a conical member to be introduced into the ampule. The ampule comprises an ampule body and a neck on one end of the body. The neck has an inside wall with means for receiving the conical member and for allowing air to pass between the syringe conical member and the ampule inside wall, but preventing liquid from passing between the conical member and the inside wall.

The sealing according to the present invention can be realized in a simple manner in that the conical member can engage on the inside wall of the ampule neck along a circular line. As a result, no liquid can flow out along the surface of the conical member and/or the inside wall of the ampule neck, even when the ampule neck is pointed downward. Yet the seal produced does not prevent air from entering into the ampule in proportion with the removal of liquid from the ampule. Thus, the ampule can be stable in its form and shape; and the liquid can be reaoved by the hypodermic syringe without attaching a hollow needle.

Another possible embodiment of the seal according to the invention involves providing one or more longitudinal grooves along the inside wall of the neck of the ampule. By means of the longitudinal grooves, the otherwise sealed assembly of the conical member on the inside wall of the neck of the ampule is interrupted. This longitudinal groove or these grooves can be constructed so that the admission of air into the ampule is less impeded than in the case of an embodiment, with a separate unit installed along a closed, circular line.

The surface pressure (contact pressure) between the conical member and the inside wall of the neck of the ampule should be simply set at the requisite value. This is particularly very advantageous for solution of the problem with the linear groove construction. Thus, in a preferred embodiment, the free end of the neck of the ampule is configured as a contact surface for the end or contact surface of the hypodermic syringe incorporating the conical member.

Furthermore, the neck of the ampule is particularly advantageous when formed with a larger diameter segment adjacent the free end of the neck. An ampule neck of this type guarantees that the engagement between the conical member and neck of the ampule can occur only in the area of the neck of the ampule determined for that purpose.

The arrangement of the neck of the ampule can be constructed so that, at least in the area intended to receive the conical member, the inside wall of the neck of the ampule is of conical or circular-cylindrical shape. A segment of this sort can be relatively easily calibrated to the desired dimensions with the desired tolerance during production of the ampule. However, it is also advantageous to provide a construction of the inside wall in the area intended for the conical member unit with a radially inwardly extending torus. A torus of that sort is likewise simple to calibrate and forms a very well defined engagement zone for the conical member.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF THE INVENTION

An inherently stable ampule 1 is produced of plastic by blow molding, and contains a pharmaceutical liquid to be injected by means of a hypodermic needle. The hypodermic syringe has a conical member on one end thereof. The conical member is engaged in a socket of a needle to connect the needle to the hypodermic syringe.

A cap 3 is attached to the neck 2 of the ampule 1. Cap 3 is configured in one piece with the neck, and is in turn also configured in one piece with a tip-stretched toggle 4. Neck 2, cap 3 and toggle 4 are formed in a known manner in connection with the filling of the body of the ampule. Ampule 1 is closed and sealed simultaneously.

Figure 3:
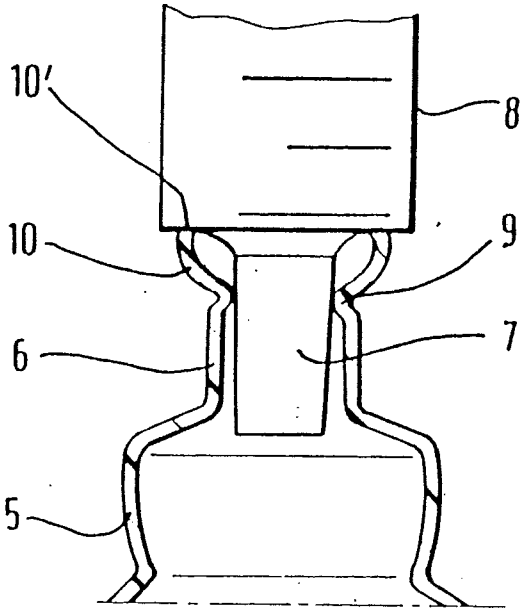
FIG. 3 is an enlarged partial side elevational view in section of the ampule of FIG. 1 with a conical member of a hypodermic syringe introduced into the ampule neck.

On the end of the ampule body, opposite the bottom of the ampule, a first segment 5 of neck 2 is attached. The diameter of first segment 5 is smaller than that of the body of the ampule. Following first segment 5, a cylindrical segment 6 is provided. Cylindrical segment 6 is still smaller in diameter, and has an inside diameter somewhat larger than the largest diameter of a standard conical member 7 for medicinal devices, which conical member is provided on the front surface of a hypodermic syringe 8. FIG. 3 shows that a third segment 9 is attached to the end of cylindrical segment 6 opposite or remote from first segment 5. Segment 9 forms a torus projecting inward over or from the inside wall of cylindrical segment 6. The inside diameter of neck 2 at its narrowest point formed by the torus is somewhat smaller than the largest diameter of conical member 7. Third segment 9 extends into a fourth segment 10 which forms a torus projecting radially outward further than cylindrical segment 6 and third segment 9 and having a larger inside diameter than third segment 9.

The fourth segment 10 is connected with cap 3 by means of a safety breaking point with reduced wall thickness. Cap 3 can be separated from neck 2 by pivoting or pushing back toggle 4. Since the front surface 10' of fourth segment 10 is exposed following the separation of cap 3 from neck 2 and forms the contact surface for the front of hypodermic syringe 8 incorporating conical member 7, the third segment 9 is spaced by an appropriate distance from front surface 10' measured in longitudinal direction along neck 2. The narrowest point of neck 2 in the area of third segment 9 is spaced longitudinally from front surface 10' such that the conical member 7 introduced into neck 2 engages with a definite, relatively low pressure on third segment 9 of neck 2, when the front surface of hypodermic syringe 8 incorporating conical member 7 engages on front surface 10'. The contact pressure between conical member 7 and the inside surface of third segment 9 is thus predetermined so that air can come into ampule 1 in the same proportion in which the ampule contents are removed by suction through conical member 7 by means of a piston incorporated in hypodermic syringe 8. The liquid contained in ampule 1 cannot be discharged along the cover or outer surface of conical member 7 or the inside surface of neck 2, even when ampule 1, as is traditional, is overturned with neck 2 pointing downward during removal of the liquid.

Figure 2:
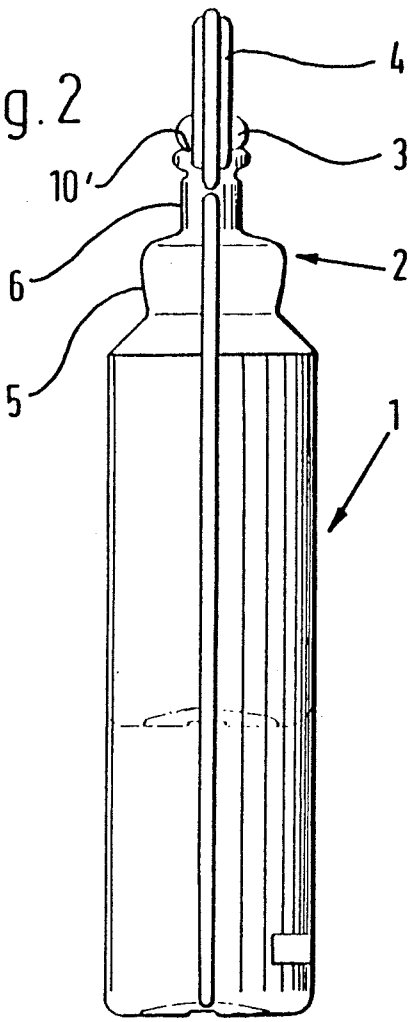
FIG. 2 is a side elevational view of the ampule of FIG. 1.
Figure 1:
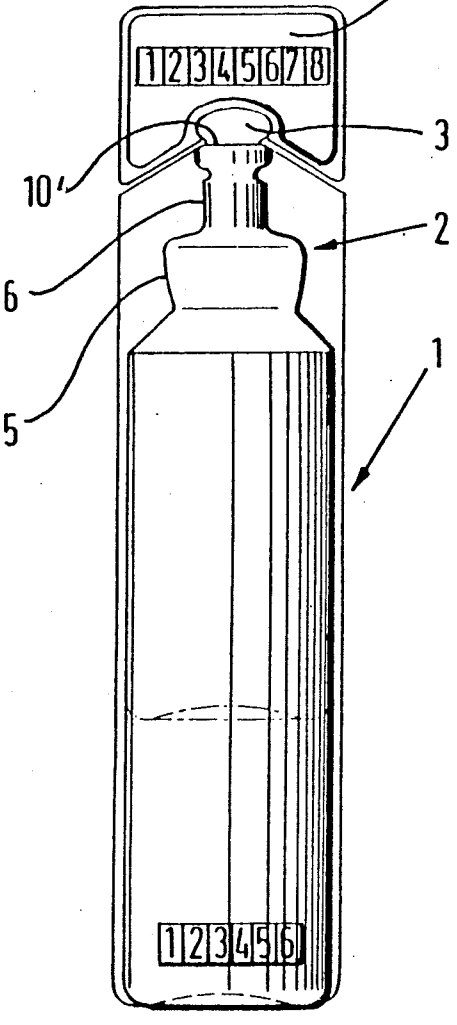
FIG. 1 is a front elevational view of an ampule according to a first embodiment of the present invention.
Figure 5:
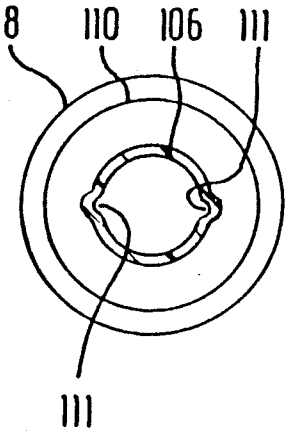
FIG. 5 is an enlarged plan view in section taken along line V—V of FIG. 4.
Figure 4:
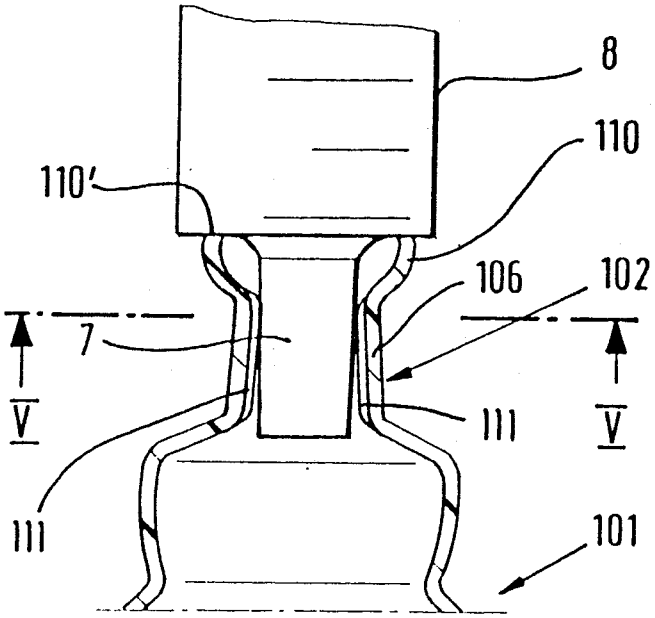
FIG. 4 is a partial side elevational view in section of an ampule according to a second embodiment of the present invention.

The partial representation of a second exemplary embodiment shown in FIG. 4 differs from the first exemplary embodiment by the neck 102 of ampule 101 having only three segments. The third segment forming the inward projecting torus of the first embodiment is deleted. However, a linear construction is attained between conical member 7 introduced into neck 102 and the inside wall of neck 102, in a self-contained construction, which prevents the passage of liquid, but allows the passage of air. The inside diameter of the cylindrical segment 106 is selected to be somewhat smaller than the largest diameter of conical member 7, but is somewhat larger than its smallest diameter. Also, the axial end of segment 110 is attached to cylindrical segment 106. Segment 106 forms an inward-projecting torus, and is selected so that conical member 7 engages with the requisite, relatively low contact pressure required to prevent the passage of liquid. The outer surface of conical member 7 engages on the inside wall of cylindrical segment 106, when the front surface of hypodermic syringe 8, incorporating conical member 7, engages on the free front surface 110' of neck 102.

To improve the passage of air between conical member 7 and neck 102, neck 102 is provided at each of two diametrically opposite points with a longitudinal groove 111. Grooves 111 open to the inside at each point. The diameter of each groove is selected so that the inflowing air prevents liquid escape. Of course, only one, single longitudinal groove could be provided or the arrangement of the groove(s) could be different.

One or more longitudinal grooves of this type could also be provided on the inside of the third segment 9 of neck 2 in the first exemplary embodiment.

While various embodiments have been chosen to illustrate the invention, it will be understood by those skilled in the art that various changes and modifications can be made therein without departing from the scope of the invention as defined in the appended claims.

What is claimed is:

1. An ampule, especially made of plastic, for a liquid to be removed from the ampule by a hypodermic syringe with a conical member at one end thereof to be introduced into the ampule, comprising:

an ampule body extending along a longitudinal axis; and a neck extending along said axis from one axial end of said body, said neck having an inside wall with seating means for receiving the concial member and for allowing air to pass betwen the conical member and said inside wall but preventing liquid from passing between the conical member and said inside wall, said neck having a free axial end with surface means generally transverse to said axis for engaging a front surface of the hypodermic syringe.

2. An ampule according to claim 1 wherein said seating means comprises a self-contained construction engaging the conical member along a circular line of said inside wall of said neck.

3. An ampule according to claim 1 wherein said neck comprises a segment having a larger inside diameter than said seating means.

4. An ampule according to claim 1 wherein said seating means comprises a torus projecting radially inwardly further than adjacent inside wall areas.

5. An ampule according to claim 1 wherein said inside wall of said neck is a circular cylinder, at least in an area of said seating means.

6. An ampule according to claim 1 wherein said inside wall of said neck is conical, at least in an area of said seating means.

7. An ampule according to claim 1 wherein said seating means comprises at least one longitudinal groove on said inside wall opening radially inwardly.

* * * * *